US008800647B2

(12) United States Patent
Kao

(10) Patent No.: US 8,800,647 B2
(45) Date of Patent: Aug. 12, 2014

(54) HIGH SPEED SWIRLING TYPE CENTRIFUGAL REVOLVING PIPELINE DEVICE

(76) Inventor: I-Nan Kao, Hsinchu County (TW)

( * ) Notice: Subject to any disclaimer, the term of this patent is extended or adjusted under 35 U.S.C. 154(b) by 450 days.

(21) Appl. No.: 13/290,244

(22) Filed: Nov. 7, 2011

(65) Prior Publication Data

US 2013/0115046 A1 May 9, 2013

(51) Int. Cl.
*F04D 3/02* (2006.01)
*F04D 1/00* (2006.01)

(52) U.S. Cl.
USPC ..... 166/105; 415/71; 415/73; 166/369

(58) Field of Classification Search
USPC ..... 166/105, 107, 369; 415/71, 73, 72, 88; 417/241, 268, 271, 94; 416/177
See application file for complete search history.

(56) References Cited

U.S. PATENT DOCUMENTS 28,526 A * 5/1860 Wappich ..... 415/72
773,316 A * 10/1904 Evans ..... 417/94
1,074,043 A * 9/1913 Bruer ..... 415/73
1,142,089 A * 6/1915 Grimes ..... 416/177
3,765,800 A * 10/1973 Foote ..... 417/241
4,318,670 A * 3/1982 Fechter et al. ..... 415/72
4,813,849 A * 3/1989 Grujanac et al. ..... 416/177
5,275,238 A * 1/1994 Cameron ..... 166/105
5,297,925 A * 3/1994 Lee et al. ..... 415/7
5,366,341 A * 11/1994 Marino ..... 415/6
6,283,275 B1 * 9/2001 Morris et al. ..... 198/677
6,406,277 B1 * 6/2002 Shafer et al. ..... 417/424.2
7,090,460 B2 * 8/2006 Englander et al. ..... 415/54.1
7,784,397 B2 * 8/2010 Vedsted et al. ..... 99/356
2009/0003986 A1 * 1/2009 Lee ..... 415/72
2009/0044954 A1 * 2/2009 Caro et al. ..... 166/369
2010/0320154 A1 * 12/2010 Ylikangas ..... 210/704
2013/0115046 A1 * 5/2013 Kao ..... 415/73

* cited by examiner

*Primary Examiner* — Daniel P Stephenson
(74) *Attorney, Agent, or Firm* — Rosenberg, Klein & Lee

(57) ABSTRACT

A high speed swirling type centrifugal revolving pipeline device, which utilizes a spiral pipeline curling and revolving with different pipe radius and with different radius of curvature, comprising an inlet pipeline, at least two transport pipelines, and at least a pressuring and accelerating pipeline, to serve as transport pipeline for fluid to continue swirling up. At least a driving device is used to drive spiral pipeline. Spiral pipeline design and centrifugal force produced by high speed rotation are used to drive fluid to the highest water level swiftly and stably, to proceed with subsequent conversion of regenerated energy into electrical power.

12 Claims, 4 Drawing Sheets

HIGH SPEED SWIRLING TYPE CENTRIFUGAL REVOLVING PIPELINE DEVICE

BACKGROUND OF THE INVENTION

1. Field of the Invention

The present invention relates to a high speed swirling type centrifugal revolving pipeline device, and in particular to a high speed swirling type centrifugal revolving pipeline device, which utilizes special design of spiral pipeline to make fluid swirl to high position in a swiftly revolving way.

2. The Prior Arts

In the conventional concept, energy resources can be found everywhere, they are readily available and inexhaustible. In this respect, though the discovery of oil that could generate electricity has brought about worldwide Industrial Revolution and tremendous progress and development, yet after 300 years of utilization and exploitation, oil depletion is now a serious problem, and it has even developed into a crisis. In recent years, most countries in the world take various measures to encourage or even subsidize Energy Regeneration, such as solar power generation, hydraulic power generation, wind power generation, ocean power generation, and biological power generation, to achieve the objective of energy conservation, while trying to prevent pollution.

In this respect, the hydraulic power generation is taken as an example for explanation, for which the water pressure is a source of power. By way of example, in ocean power generation, the potential difference generated by ocean waves, ocean currents, temperature differences, and surges is converted into pressure, which is stored and then released as stable pressure, and finally it is converted into electricity. Researches conducted recently shows that, pressure forms naturally at the deep bottom of water, and the deeper the water the greater the pressure, and the more electricity can be generated. Moreover, since the energy produced from the water bottom pressure is stable and readily available, it is suitable for developing into a regenerated energy, while achieving environment protection.

However, since the locations of deep water is not easy to find readily, so when the depth of water and therefore the pressure is not sufficient, then it is desired to increase the depth of water to raise the water pressure. Presently, an approach to do this is to make use of water pump or centrifugal pump, to achieve vacuum by utilizing rotation turbine, and then utilize the atmospheric pressure to squeeze the water at bottom into the vacuum of water pipeline, thus driving the water to an increased height. Usually, for an ordinary pump, the maximum range of the driving water is 260 feet, yet it must consume large amount of electric power to reach that range. In this way, the water output is limited, so it can not realize its full efficacy. Besides, the environment pollution problem has to be solved.

Therefore, presently, the design and performance of water pipeline for hydraulic power generation is not quite satisfactory, and it has much room for further improvements.

SUMMARY OF THE INVENTION

In view of the problems and shortcomings of the prior art, the present invention provides a high speed swirling type centrifugal revolving pipeline device, that is capable of producing regenerated energy, and solving the drawbacks of the prior art.

A major objective of the present invention is to provide a high speed swirling type centrifugal revolving pipeline device, that simulates the principle of tornado formation to generate a strong centrifugal force, and uses a spiral pipeline spatial design, so that the fluid under centripetal force is made to change it direction in a fast and spiral rotation way, to make the fluid to generate a centrifugal force, and due to the differences of radius of spiral pipeline and its rotation radius of curvature, the fluid is made to curl and move in the spiral pipeline automatically, so that it is pressured and accelerated until its reaches the maximum height, and then it is released, and this process is repeated cyclically to realize subsequent Energy Regeneration.

Another objective of the present invention is to provide a high speed swirling type centrifugal revolving pipeline device, that is simple in construction and easy to install; and that can be applied to various environments depending on the actual requirements, and is capable of meeting the requirements of environment protection.

A yet another objective of the present invention is to provide a high speed swirling type centrifugal revolving pipeline device, that can be used on the land, in a lake, or in a sea, to fully utilize the water resources cyclically and repeatedly. Also, in this hydraulic power generation process, there is no need of complicated equipment or large amount of driving power. It is safe in operation, stable in performance, while achieving environment protection.

To achieve the objective mentioned above, the present invention provides a high speed swirling type centrifugal revolving pipeline device, comprising: a base stand, an inlet pipeline, at least two transport pipelines, at least one pressuring and accelerating pipeline, and at least a driving device. The base stand includes a base, a bearing base, and a central column connected to the base, and the bearing base is disposed between the base and the central column. Inlet pipeline is disposed on the base stand and encircles the central column. The inlet pipeline is provided with at least a first spiral pipe, with its pipe radius and radius of curvature decreasing and curling from its front end to its rear end, to exert pressure on the fluid flowing in the first spiral pipe, so that the flowing speed of the fluid increases along with the variations of pipe radius and its radius of curvature, to lift and move the fluid upward. Two transport pipelines encircle the central column, and are connected to the inlet pipeline. The transport pipeline is provided with at least a second spiral pipe, with its radius and radius of curvature remain the same from its front end to its rear end. As such, through the centrifugal force produced by high speed rotation, the second spiral tube is able to receive the fluid coming from the first spiral pipe, and continues to push the fluid upward. The pressuring and accelerating pipeline encircles the central column, and is connected between two transport pipelines, and it is provided with at least a third spiral pipe, with its radius and radius of curvature increasing and curling, and then decreasing and curling from its front end to its rear end, so as to exert pressure on fluid in two transport pipelines and accelerate it to move upward. The driving device is to drive the fluid in the inlet pipeline, the pressuring and accelerating pipeline, and the transport pipeline into rotation. Meanwhile, the bearing base connected to the inlet pipeline move in synchronism, to enhance the force of rotation.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed descriptions with reference to the attached drawings.

In the present invention, the principle of strong centrifugal force generated by a tornado is used in the development of regenerated energy by means of water resources. Among the list of Regenerated Energies, the hydraulic power generation has the advantages of high efficiency, low cost, high stability, so that the purpose of the present invention is to solve and overcome the shortcomings and limitations of the prior art in this field.

Figure 1:
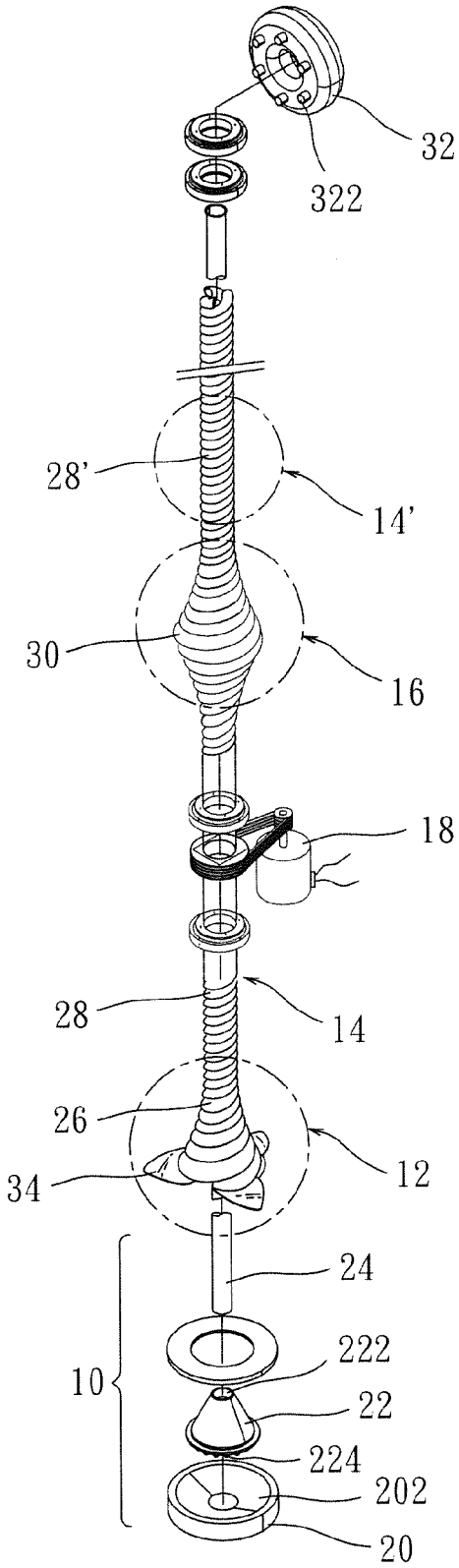
FIG. 1 is a schematic diagram of a high speed swirling type centrifugal revolving pipeline device according to a first embodiment of the present invention.

The present invention provides a high speed swirling type centrifugal revolving pipeline device. Refer to FIG. 1 for a schematic diagram of a high speed swirling type centrifugal revolving pipeline device according to the first embodiment of the present invention. As shown in FIG. 1, the high speed swirling type centrifugal revolving pipeline device includes: a base stand 10, an inlet pipeline 12, at least two transport pipelines 14 and 14', at least a pressuring and accelerating pipeline 16, and at least a driving device 18. The base stand 10 includes a base 20, a bearing base 22, and a central column 24, and the bearing base 22 is disposed between the base 20 and the central column 24. Wherein, the base 20 is provided with an arc-shaped dent portion 202, in the center of the bearing base 22 is provided with a central axial hole 222, and at its bottom is provided and encircled with a plurality of rolling beads 224, such that the central column 24 is able to pass through the central axial hole 222 to reach the base 20 and is fixed therein. The rolling beads 224 are provided in the arc-shaped dent portion 202, so that they can rotate therein.

Inlet pipeline 12 is disposed on the base stand 10 and encircles the central column 24. The inlet pipeline 12 is provided with at least a first spiral pipe 26, with its radius and radius of curvature decreasing and curling from its front end to rear end in resembling a trumpet. More specifically, from the front end, it curls and revolves several circles upward in a spiral-shaped toward its rear end, with its radius of curvature decreasing while curling and revolving upward, so that it is disposed and encircles the outer perimeter of the central column 24, with its front end radius greater than that of its rear end. In order to match with the design of decreasing and curling radius of curvature of the first spiral tube 26, the bearing base 22 of the base stand 10 can be of a cone shape, so that the first spiral pipe 26 can be installed correspondingly on the cone-shape bearing base 22.

Two transport pipelines 14 and 14' encircle the central column 24, and are provided respectively with at least a second spiral pipe 28 and 28'. The pressuring and accelerating pipeline 16 are disposed and encircles the central column 24, and is connected between two transport pipelines 14 and 14', and that will be explained in detail later. Wherein, the structures of the two transport pipelines 14 and 14' are the same, here the transport pipeline 14 is taken as example for explanation, with its front end curling and revolving several circles upward in a spiral-shape toward its rear end, with its front end radius and radius of curvature equal to that of the rear end. Moreover, the radius of the front end of the second spiral pipe 28 is the same as that of the rear end of the first spiral pipe 26, so they can be connected smoothly together. The pressuring and accelerating pipeline 16 is provided with at least a third spiral pipe 30, with its radius and radius of curvature increasing and curling, and then decreasing and curling, from its front end to rear end. To be more specific, from its front end, the spiral pipe curls and revolves in a spiral shape upward several circles to the rear end, with its radius of curvature increasing along with its curling and revolving upward until a preset outside radius, then it likewise curls and revolves several circles toward the rear end with decreasing radius of curvature, so that it encircles around the outer perimeter of central column 24, with its front end radius the same as that of the rear end. In addition, the front end radius and rear end radius of the third spiral pipe 30 are the same as those of the second spiral pipes 28 and 28', such that the rear end of the second spiral pipe 28 can be connected to the front end of the third spiral pipe 30; and the front end of the second spiral pipe 28' is connected to the rear end of the third spiral pipe 30. In the present embodiment, the high speed swirling type centrifugal revolving pipeline device further includes a drain collection device 32, disposed at the top end of the transport pipeline 14. Namely, the rear end of the second spiral pipe 28' is connected to the drain collection device 32, so that the fluid may flow through the first spiral pipe 26, the second spiral pipe 28, the third spiral pipe 30, and the second spiral pipe 28' in sequence, and it finally exits from the drain collection device 32 via the second spiral pipe 28'.

After explaining the overall structure of the present invention, subsequently, its way of implementation is explained. In the present invention, the fluid can be moved and be transported to the highest position of the pipeline device, since the fluid can be deformed into any shape, the centrifugal and centripetal forces it produces at that position is the strongest, therefore, fluid is used in the present invention as a medium for implementation, and fluid such as ordinary water, sea water, well water, and lake water are taken as example for explanation. When transporting water in a deep water area to a preset high position for releasing, firstly, a driving device 18 such as an electric motor 18 (with a power of 285 Kw, and a rotation speed 1800 RPM, namely 30 revolutions per second) is used to drive the inlet pipeline 12, two transport pipelines 14 and 14', and the pressuring and accelerating pipeline 16 in sequence into rotation. Meanwhile, the bearing base 22 connected to the inlet pipeline 12 is actuated into action in synchronism, such that the rolling beads at the bottom of the bearing base 22 will rotate 360 degrees in the dented portion 202 of the base 20, to enhance momentum and smoothness of the overall rotation.

In the description mentioned above, the front end of the first spiral pipe 26 is further provided with a plurality of blades 34, resembling those of a propeller of a ship, so that when the first spiral pipe 26 starts to rotate, these blades 34 also start to rotate in synchronism, to produce pushing action during rotation, so as to push the entire first spiral pipe 26, the second spiral pipes 28 and 28', and the third spiral pipe 30 to move upward. By way of example, in case that the structure mentioned above is pushed upward 0.5 mm, such that in such a high speed rotation, the structure is in a weightless state, that means that it is operated in a frictionless state, as such reducing the power required for driving the driving device 18, while raising the rotation speed.

When the inlet pipeline 12 is rotated at high speed, the centrifugal force it produces can force the water at the deep bottom portion into the first spiral pipe 26 continuously. Since for the first spiral pipe 26, its pipe radius and radius of curvature decrease and curl from its front end to rear end, therefore, the front end radius is larger, so the amount of its inlet water is relatively large. Also, since the revolving and curling radius of the front end is larger, its relative rotation speed is faster, as such the water pressure and its flowing speed will increase instantaneously along its decreasing radius and radius of curvature. In other words, the centrifugal force produced by the rotation of the first spiral pipe 26 will not only force the water to lose its weight and being pressured, but it also increases its flowing speed to push upward, in forcing the water to move upward.

The second spiral pipe 28 receives the water coming from the first spiral pipe 26, due to the equal pipe radius and radius of curvature for the front end and the rear end of the second spiral pipe 28, and the centrifugal force produced by high speed rotation, water in the second spiral pipe 28 is pushed upward continuously under the same pressure and flowing speed, to realize water transport. In order to move water up continuously, the special design of the third spiral pipe 30 is used to make water be operated under increased pressure and acceleration. More specifically, the third spiral pipe 30 receives the water coining from the second spiral pipe 28, when water flows in from the front end of the third spiral pipe 30, in this high speed rotation, and due to its pipe radius and radius of curvature increases from front end to rear end, so that its degree of vacuum inside is increased, thus its water suction force is increased; then water continues to move along the third spiral pipe having decreasing pipe radius and radius of curvature, and in this process, due to the decreasing radius of curvature, its linear speed is reduced, and since the pipe radius is decreasing, so that water in the third spiral pipe 30 is compressed to increase its flowing speed, thus pushing the water continuously upward.

After being pressured and accelerated along the third spiral pipe 30, then water is received by the second spiral pipe 28'. Likewise, its operation is the same as that for the second spiral pipe 28 in that, the centrifugal force generated by the high speed rotation pushes the water inside to move upward continuously with the same pressure and flowing speed, until it reaches the rear end, then a drain collection device 32 will exit the water output by the second spiral pipe 28' back again into the deep water area, or to a predetermined location at high place. The bottom of the drain collection device 32 may further include a plurality of drainage holes 322, that are used to exit the water output by the second spiral pipe 28', or these drainage holes 322 can be connected to various drainage pipelines, to meet the various water resources requirements of the environment.

In the descriptions mentioned above, when the water is swirled to the highest position and level, the pressure at the bottom of the deep water will increase to its maximum, that means that the pressure at the bottom of the deep water is proportional to the height of the water, so that much more electrical power can be generated. As such, the pressure at the bottom of the deep water can be converted directly to electric power, to meet the power requirement of the environment. Therefore, not only the power loss during long distance transmission can be eliminated, but the water resources can also be used repeatedly to generate electricity, in addition, its cost of generating electricity is lower, hereby achieving the ultimate goal of energy regeneration and environment protection.

In the present invention, the number of the first spiral pipe 26, the second spiral pipe 28 and 28', and the third spiral pipe 30 utilized can be more than two, and they can be grouped together into a set curling and revolving in the same direction. For example, using two spiral pipes and combining them into a set, may increase its efficiency two times; while using three spiral pipes grouping and combining them into a set, may increase its efficiency three times, etc. In the first embodiment, for the respective first spiral pipe 26, second spiral pipe 28 and 28', and third spiral pipe 30, three spiral pipes grouped into a set revolving and curling in the same direction are taken as an example for explanation.

Figure 2:
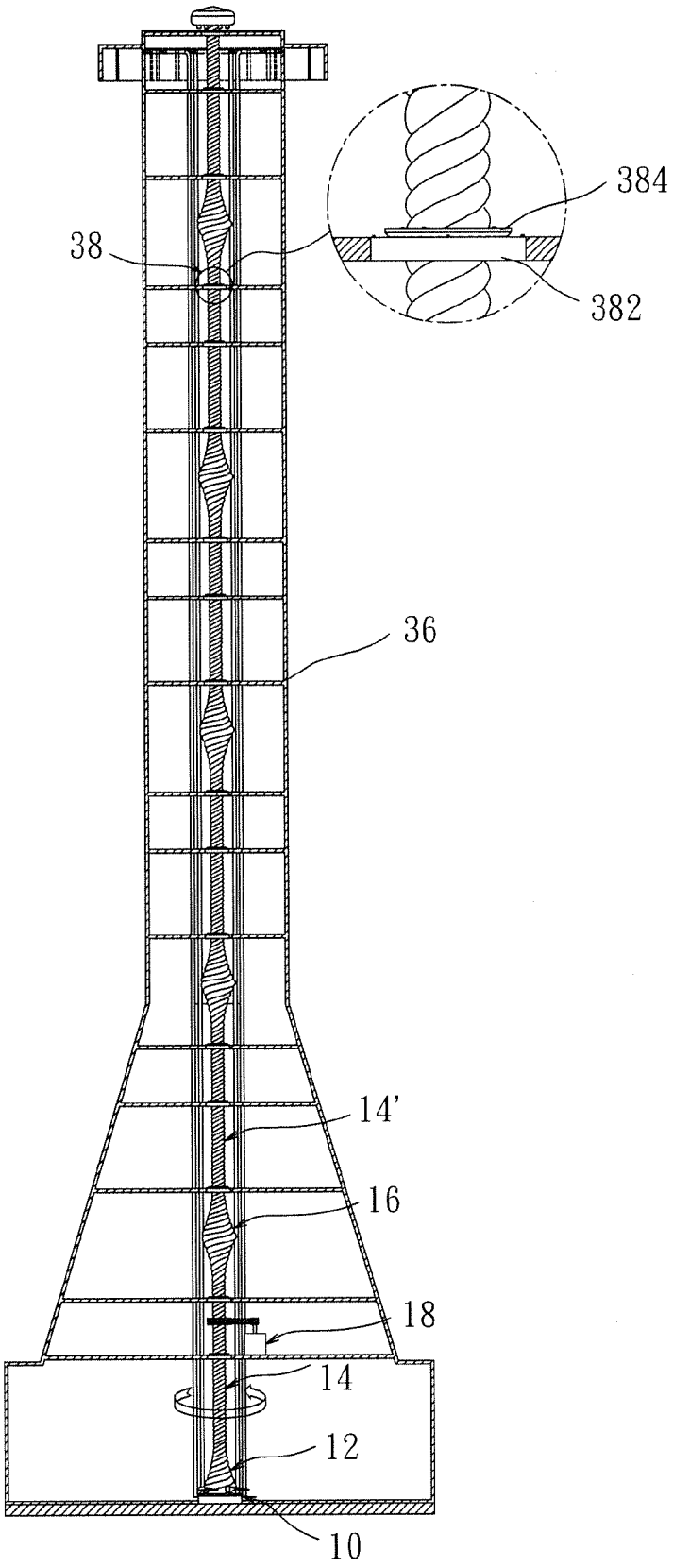
FIG. 2 is a schematic diagram of a high speed swirling type centrifugal revolving pipeline device according to a second embodiment of the present invention.

Then, refer to FIG. 2 for a schematic diagram of a high speed swirling type centrifugal revolving pipeline device according to a second embodiment of the present invention. The difference between the second and first embodiments is that, the high speed swirling type centrifugal revolving pipeline device further includes an outer frame 36, and at least a bearing device 38. Wherein, the bearing device 38 includes a outer bearing 382, and an inner bearing 384; the inner bearing 384 encircles at least a transport pipeline 14 (or pipeline 14'). The inner bearing 384 is further encircled by a plurality of rolling beads (not shown), and when the transport pipeline 14 rotates, the rolling beads rotate inside the outer bearing 382 in synchronism, to raise the overall rotation speed; moreover, the outer bearing 382 is fixed onto the outer frame 36, so that the rotation of the entire device can be more stable, thus during rotation, it will not deviate due to the centrifugal force. The outer frame 36 is used to fix the base stand 10, the inlet pipeline 12, two transport pipelines 14 and 14', the pressuring and accelerating pipeline 16, the driving device 18, and the bearing device 38 inside, to raise its operational stability and prevent it from being damaged by outside factors through the protection of the outer frame 36. In addition, in case that the present invention is put into a deep water or into a deep sea, the outer frame 36 can be designed as a sealed and enclosed body, thus in addition to protecting the device inside, it can also resist against surge, the erosion of sea water, and the attached microorganism in deep water, in prolonging service life of the device of the present invention.

Furthermore, the water transport height can be increased depending on actual requirement, and this requires to use a plurality of transport pipelines and a pressuring and accelerating pipelines 16, with the pressuring and accelerating pipeline 16 disposed between the adjacent transport pipelines 14 and 14', and its operation principle the same as that of the first embodiment, thus it will not repeated here for brevity. Therefore, increased water transport height can be realized through installing a plurality of transport pipelines and a pressuring and accelerating pipelines 16, so that the pressure at the bottom of deep water is greater, and that can be converted into much more electrical power of regenerated energy, to meet the power requirements of various environments. Moreover, the number of bearing devices 38 can be increased corresponding to that of the transport pipelines 14 and 14', hereby enhancing the momentum and smoothness of the overall rotation, and reducing the power required to drive the driving device 18.

Figure 3:
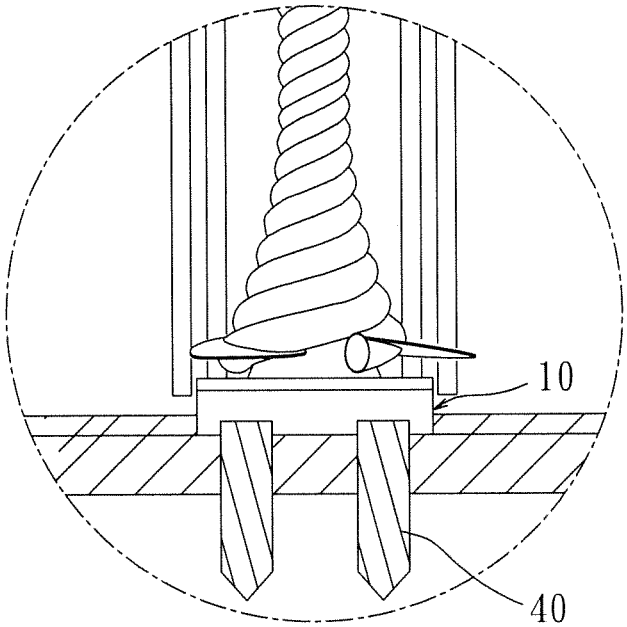
FIG. 3 is an enlarged view of the encircled portion of FIG. 2 according to the present invention.

Moreover, in order to apply the present invention in various environments, such as on the land, in a lake, or in a sea, refer to FIG. 3 for a an enlarged view of the encircled portion of FIG. 2 according to the present invention. As shown in FIG. 3, the base stand 10 is further provided with at least a fixing piece 40, that can be fixed onto an installation plane, such as on the bottom plane of land, lake, or sea, so that the overall device can be securely and stably fixed in any of the environments.

Figure 4:
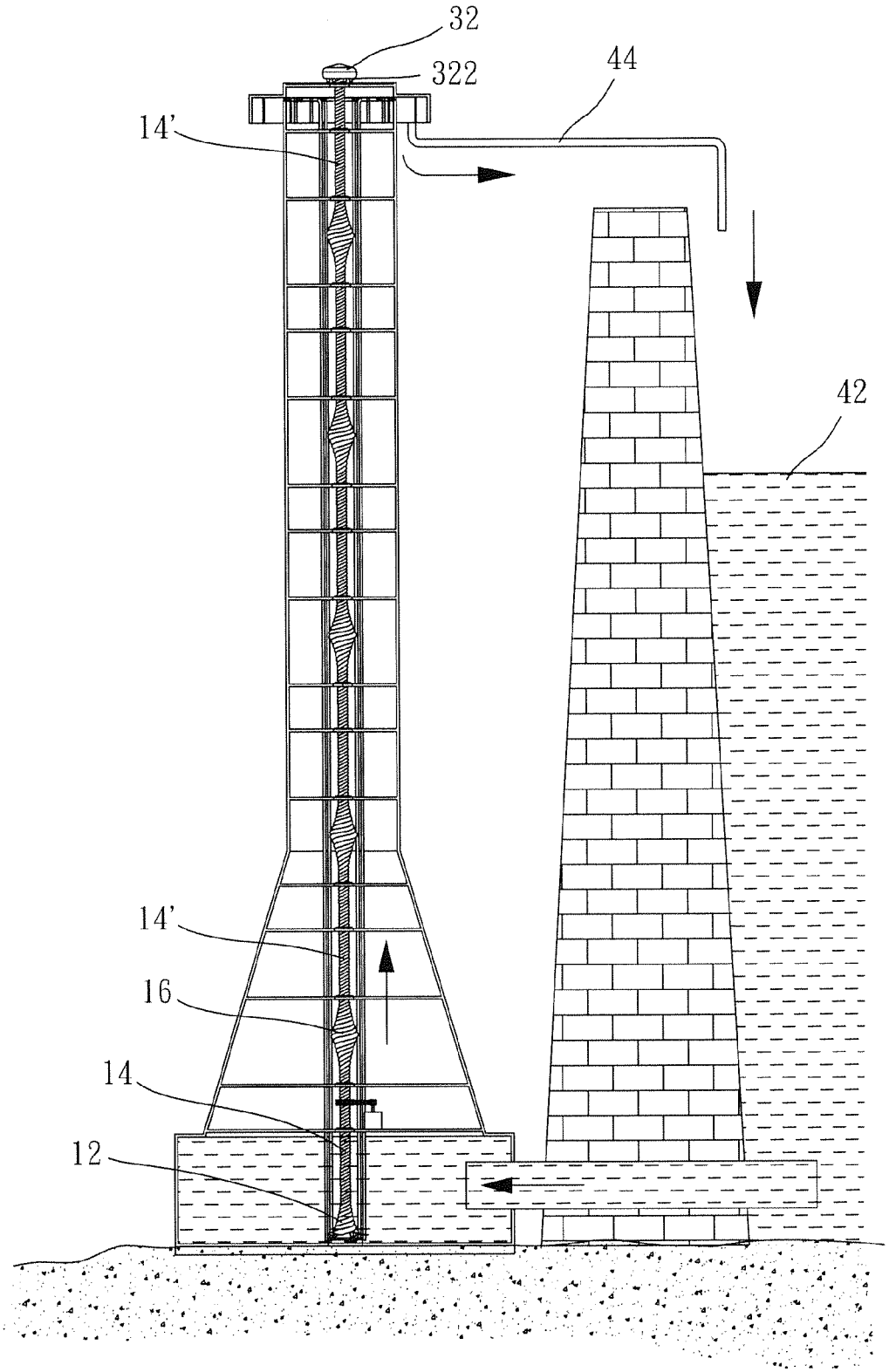
FIG. 4 is a schematic diagram of a high speed swirling type centrifugal revolving pipeline device according to a third embodiment of the present invention.

Finally, refer to FIG. 4 for a schematic diagram of a high speed swirling type centrifugal revolving pipeline device according to a third embodiment of the present invention. As shown in FIG. 4, water is introduced from a water area 42 into a high speed swirling type centrifugal revolving pipeline device, and through inlet pipeline 12, a plurality of transport pipelines 14 and 14', and a pressuring and accelerating pipelines 16, the water is raised continuously to the highest position, namely the transport pipeline 14' on the top, thus being able to proceed with conversion of regenerated energy into electrical power, then exit the water from the drainage hole 322 at the bottom of the drain collection device 32. As shown in FIG. 4, one of the drainage holes 322 can be connected to a drainage pipeline 44, so that water is exited repeatedly back into the water area 42 via the drainage pipeline 44, and the water resources can be used repeatedly and cyclically in a hydraulically power generation process, without the need of complicated equipment and enormous driving power, such that it can not only realize safe and stable operation and performance, but it can also achieve energy conservation and environment protection.

To be more specific, in case that the present invention is set up and used at sea, since the sea may have deeper and wider scope for development, thus in addition to higher efficiency in generating electricity, it may obtain special by-products readily from the sea, such as deep sea water and liquid gold, hereby raising the added-value of the present invention, and having a good competitive edge in the market.

Summing up the above, in the present invention, spiral pipeline spatial design is used, so that the fluid under centripetal force is made to change it direction in a fast and spiral rotation way, to make the fluid generate a centrifugal force, and due to the differences of pipe radius and its rotation radius of curvature, the fluid is made to curl and move upward in the spiral pipeline automatically, so that it is pressured and accelerated until its reaches the maximum range and is released, and this process is repeated cyclically to realize energy regeneration. Moreover, the present invention is simple in construction and easy to install; and it can be applied to various environments, and be installed at required site and height, to meet the requirements of electric power and environment protection.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A high speed swirling type centrifugal revolving pipeline device, comprising:

a base stand, including a base, a bearing base, and a central column connected to said base, and said bearing base is disposed between said base and said central column;

an inlet pipeline, disposed on said base stand and encircles said central column, said inlet pipeline is provided with at least a first spiral pipe, with its radius and radius of curvature decreasing and curling, to push fluid to move upward;

at least two transport pipelines, encircling said central column, and is connected to said inlet pipeline, each of said transport pipelines is provided with at least a second spiral pipe, with its pipe radius and radius of curvature remain same from its front end to its rear end, said second spiral pipe receives fluid coming from said first spiral pipe, and continues to push the fluid upward;

at least one pressuring and accelerating pipeline, encircling said central column, and is connected between said two transport pipelines, and it is provided with at least a third spiral pipe, with its radius and radius of curvature increasing and curling, and then decreasing and curling, so as to exert pressure on fluid in said at least two transport pipelines and accelerate it to move upward; and at least a driving device, to drive fluid in said inlet pipeline, said pressuring and accelerating pipeline, and said transport pipeline into rotation.

2. The high speed swirling type centrifugal revolving pipeline device as claimed in claim 1, further comprising: a drain collection device, disposed on top end of said transport pipeline, to exit said fluid output by said second spiral pipe.

3. The high speed swirling type centrifugal revolving pipeline device as claimed in claim 2, wherein a plurality of drainage holes are provided at bottom of said drain collection device, to exit said fluid output by said second spiral pipe.

4. The high speed swirling type centrifugal revolving pipeline device as claimed in claim 1, wherein a front end of said first spiral pipe is provided with a plurality of blades, that rotate in synchronism with said first spiral pipe to generate a push action.

5. The high speed swirling type centrifugal revolving pipeline device as claimed in claim 1, wherein a pipe radius of said second spiral pipe, said pipe radius of said front end and rear end of said third spiral pipe, and said pipe radius of said rear end of said first spiral pipe are same.

6. The high speed swirling type centrifugal revolving pipeline device as claimed in claim 1, wherein number of said first spiral pipe, said second spiral pipe, and said third spiral pipe is more than two, and they are grouped into a set curling and revolving in a same direction.

7. The high speed swirling type centrifugal revolving pipeline device as claimed in claim 1, further comprising: an outer frame, to fix said base stand, said inlet pipeline, said pressuring and accelerating pipeline, said two transport pipeline, and said driving device inside.

8. The high speed swirling type centrifugal revolving pipeline device as claimed in claim 7, wherein said outer frame is a sealed and enclosed body, and is disposed in sea or deep water.

9. The high speed swirling type centrifugal revolving pipeline device as claimed in claim 7, further comprising: at least a bearing device, which includes an outer bearing and an inner bearing inside, said inner bearing encircles at least a said transport pipeline, and said outer bearing is fixed onto said outer frame.

10. The high speed swirling type centrifugal revolving pipeline device as claimed in claim 1, wherein when there are a plurality of said transport pipelines and said pressuring and accelerating pipelines, said pressuring and accelerating pipeline is disposed between said adjacent transport pipelines.

11. The high speed swirling type centrifugal revolving pipeline device as claimed in claim 1, wherein said base stand is further provided with a fixing piece, to be buried and fixed into an installation plane.

12. The high speed swirling type centrifugal revolving pipeline device as claimed in claim 1, wherein said driving device is an electric motor.

* * * * *